US011495155B2

(12) United States Patent
Lin et al.

(10) Patent No.: US 11,495,155 B2
(45) Date of Patent: Nov. 8, 2022

(54) PIXEL CIRCUIT

(71) Applicant: AU Optronics Corporation, Hsin-Chu (TW)

(72) Inventors: Chih-Lung Lin, Hsin-Chu (TW); Chin-Hsien Tseng, Hsin-Chu (TW); Po-Cheng Lai, Hsin-Chu (TW); Yu-Sheng Lin, Hsin-Chu (TW); Mao-Hsun Cheng, Hsin-Chu (TW)

(73) Assignee: AU OPTRONICS CORPORATION, Hsin-Chu (TW)

( * ) Notice: Subject to any disclaimer, the term of this patent is extended or adjusted under 35 U.S.C. 154(b) by 127 days.

(21) Appl. No.: 16/952,199

(22) Filed: Nov. 19, 2020

(65) Prior Publication Data

US 2021/0074195 A1 Mar. 11, 2021

Related U.S. Application Data

(63) Continuation of application No. 16/436,126, filed on Jun. 10, 2019, now Pat. No. 10,916,169.

(60) Provisional application No. 62/684,913, filed on Jun. 14, 2018.

(30) Foreign Application Priority Data

Jan. 4, 2019 (TW) ..... 108100427

(51) Int. Cl.
*G09G 3/3208* (2016.01)
*G09G 3/20* (2006.01)

(52) U.S. Cl.
CPC ..... *G09G 3/20* (2013.01); *G09G 2300/043* (2013.01); *G09G 2300/0426* (2013.01); *G09G 2300/0809* (2013.01)

(58) Field of Classification Search
CPC ..... G09G 3/3233; G09G 3/3208; G09G 2320/043; G09G 3/3258
See application file for complete search history.

(56) References Cited

U.S. PATENT DOCUMENTS

| | | | | |
|---|---|---|---|---|
| 6,542,138 | B1 * | 4/2003 | Shannon | G09G 3/3233 315/169.3 |
| 6,734,636 | B2 | 5/2004 | Sanford et al. | |
| 10,984,723 | B1 * | 4/2021 | Zhou | G09G 3/3258 |
| 2014/0176523 | A1 | 6/2014 | Kwak | |
| 2018/0122301 | A1 | 5/2018 | Yoon et al. | |
| 2018/0308426 | A1 | 10/2018 | Han et al. | |
| 2019/0035332 | A1 | 1/2019 | Liu | |

FOREIGN PATENT DOCUMENTS

| | | |
|---|---|---|
| CN | 104680977 | 6/2015 |

* cited by examiner

*Primary Examiner* — Yuzhen Shen
(74) *Attorney, Agent, or Firm* — WPAT, PC

(57) ABSTRACT

A pixel circuit includes a light emitting element, a first driver transistor, a second driver transistor, and a first compensation capacitor. A first terminal of the first driving transistor is configured to receive a power signal, and a second terminal of the first driving transistor is electrically coupled to the light emitting element. A first terminal of the second driving transistor receives the power signal, and a control terminal of the second driving transistor is electrically coupled to the light emitting element. The first compensation capacitance is electrically coupled to a control terminal of the first driving transistor and the second terminal of the second driving transistor, respectively.

4 Claims, 6 Drawing Sheets

PIXEL CIRCUIT

CROSS-REFERENCE TO RELATED APPLICATION

This application is a continuation of application Ser. No. 16/436,126, filed Jun. 10, 2019, which claims priority to U.S. Provisional Application Ser. No. 62,684/913, filed Jun. 14, 2018, and Taiwan Application Serial Number 108100427, filed Jan. 4, 2019, the disclosures of which are incorporated herein by reference in their entireties.

BACKGROUND

Technical Field

The present disclosure relates to a pixel circuit, and more particularly to a pixel circuit capable of compensating for threshold voltage variation of a driving transistor.

Description of Related Art

Low temperature poly-silicon thin-film transistors have high carrier mobility and small size, and are suitable for high resolution, narrow bezel and low power consumption display panels. Currently, excimer laser annealing technique is widely used to form the poly-silicon thin-film of the low temperature poly-silicon thin-film transistors. However, since the scan power of each of the excimer lasers is not stable, the poly-silicon thin-film of different regions will have a difference in grain size and number. Therefore, the characteristics of the low temperature poly-silicon thin-film transistor will be different in different regions of the display panel. For example, low temperature poly-silicon thin-film transistors in different regions will have different threshold voltages.

At present, the technique of in-pixel compensation is widely used to overcome the above mentioned problem of threshold voltage variation. However, the pixel circuit having the in-pixel compensation function has a complicated circuit structure, so that the aperture ratio of the associated display panel is low.

SUMMARY

One aspect of the present disclosure is a pixel circuit, including a light emitting element, a first driver transistor, a second driver transistor and a first compensation capacitor. The first driver transistor includes a first terminal, a second terminal and a control terminal. The first terminal of the first driving transistor is configured to receive a power signal, and the second terminal of the first driving transistor is electrically connected to the light emitting element. The second driver transistor includes a first terminal, a second terminal and a control terminal. The first terminal of the second driving transistor receives the power signal, and the control terminal of the second driving transistor is electrically connected to the light emitting element. The first compensation capacitor is electrically connected to the control terminal of the first driving transistor and the second terminal of the second driving transistor.

Another aspect of the present disclosure is a pixel circuit, including a light emitting element, a first driver transistor, a second driver transistor and a first compensation capacitor. The first driver transistor includes a first terminal, a second terminal and a control terminal. The second terminal of the first driving transistor is electrically connected to the light emitting element. The second driver transistor includes a first terminal, a second terminal and a control terminal, wherein the control terminal of the second driving transistor is electrically connected to the light emitting element. The first compensation capacitor is electrically connected to the control terminal of the first driving transistor and the second terminal of the second driving transistor, and a compensation node between the first compensation capacitor and the second driving transistor. The control terminal of the first driver transistor is configured to receive a data signal in a data input period. The voltage of the compensation node is substantially twice a voltage of the control terminal of the second driving transistor in a compensation period.

It is to be understood that both the foregoing general description and the following detailed description are by examples, and are intended to provide further explanation of the disclosure as claimed.

BRIEF DESCRIPTION OF THE DRAWINGS

The present disclosure can be more fully understood by reading the following detailed description of the embodiment, with reference made to the accompanying drawings as follows.

DETAILED DESCRIPTION

For the embodiment below is described in detail with the accompanying drawings, embodiments are not provided to limit the scope of the present disclosure. Moreover, the operation of the described structure is not for limiting the order of implementation. Any device with equivalent functions that is produced from a structure formed by a recombination of elements is all covered by the scope of the present disclosure. Drawings are for the purpose of illustration only, and not plotted in accordance with the original size.

It will be understood that when an element is referred to as being "connected to" or "coupled to", it can be directly connected or coupled to the other element or intervening elements may be present. In contrast, when an element to another element is referred to as being "directly connected" or "directly coupled," there are no intervening elements present. As used herein, the term "and/or" includes an associated listed items or any and all combinations of more.

Figure 1:
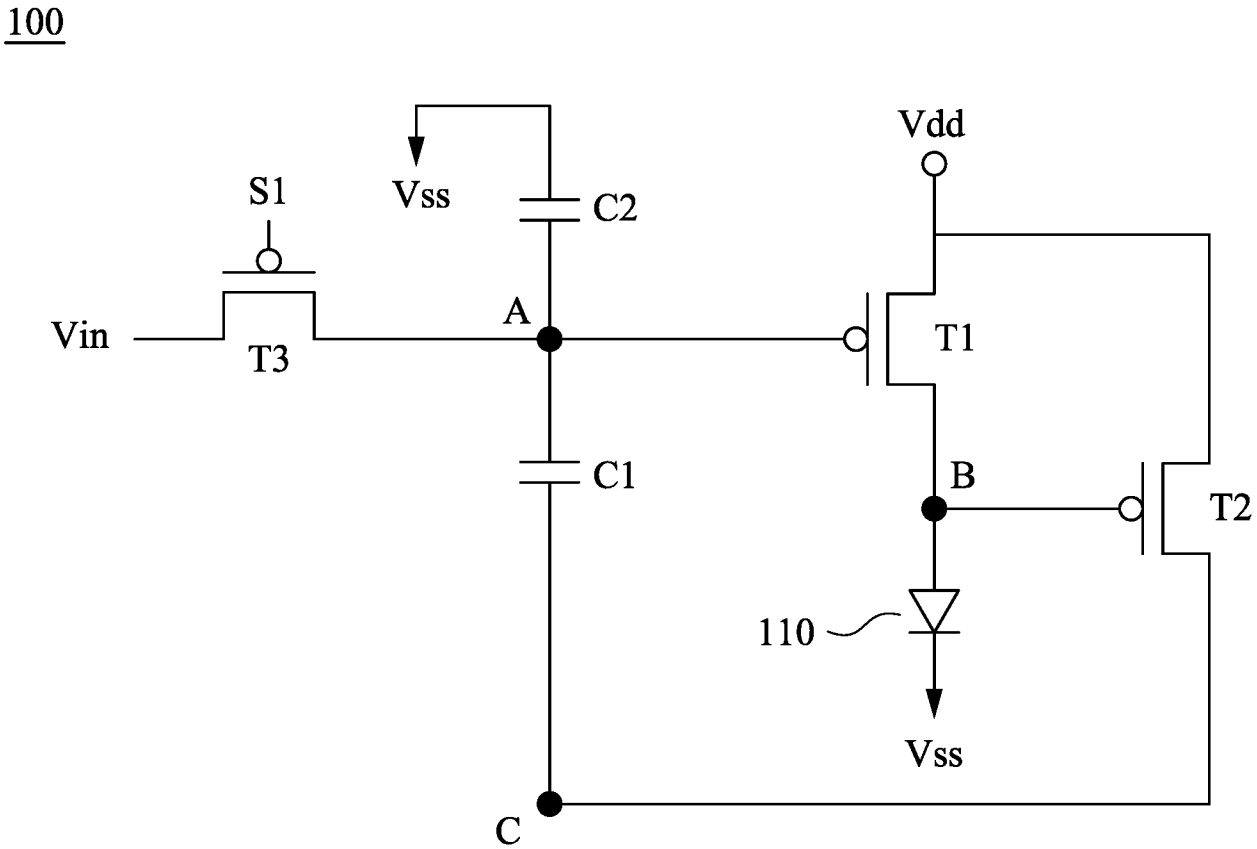
FIG. 1 is a schematic diagram of a pixel circuit in some embodiments of the present disclosure.

As shown in FIG. 1, FIG. 1 is a schematic diagram of a pixel circuit in some embodiments of the present disclosure. The pixel circuit 100 includes a light emitting element 110, a first driver transistor T1, a second driver transistor T2 and a first compensation capacitor C1. In some embodiments, the light emitting element 110 includes at least a Light-emitting diode, such as Organic Light-Emitting Diode. In the embodiment, the first driver transistor T1 includes a first terminal, a second terminal and a control terminal, the first terminal of the first driver transistor T1 is configured to receive a power signal Vdd, the second terminal of the first driver transistor T1 is electrically connected to the light emitting element 110. Specifically, the light emitting element 110 includes a positive terminal and a negative terminal, and the second terminal of the first driver transistor T1 is electrically connected to the positive terminal of the light emitting element 110.

In the embodiment, the second driver transistor T2 includes a first terminal, a second terminal and a control terminal. The first terminal of the second driver transistor T2 is also configured to receive the power signal Vdd, the control terminal of the second driver transistor T2 is electrically connected to the positive terminal of the light emitting element 110. The first compensation capacitor C1 is electrically connected to the control terminal of the first driving transistor T1 and the second terminal of the second driving transistor T2. In some embodiments, the second terminal of the second driver transistor T2 is electrically connected to the first compensation capacitor C1 through a compensation node C. The threshold voltage value Vth of the first driver transistor T1 matches to the threshold voltage value Vth of the second driver transistor T2.

Accordingly, since the entire pixel circuit 100 can be controlled by a single signal line (i.e., controlling the voltage of the control terminal of the first driver transistor T1), the circuit architecture can be effectively simplified. Compared with the general pixel circuit, because it needs to control at least one additional transistor switch to compensate for the variation of the threshold voltage of the driving transistor, the circuit is more complicated and requires multiple control signal lines. The pixel circuit of the present disclosure achieves compensation by matching the first driver transistor T1 and the second driver transistor T2 with each other. Therefore, there is no need to use an additional signal control line to control the second driver transistor T2.

In some embodiments, when the pixel circuit 100 is in the data input period, the control terminal of the first driver transistor T1 is configured to receive the data signal, so that the voltage of the compensation node C is substantially twice the voltage of the control terminal of the second driving transistor T2 when the pixel circuit 100 is in the compensation period in order to compensate for the effect of the threshold voltage Vth variation of the transistor. According to this, the light emitting element 110 produces the desired lightness.

In some embodiments, the pixel circuit 100 further includes a second compensation capacitor C2. The second compensation capacitor C2 includes a first terminal and a second terminal. The first terminal of the second compensation capacitor C2 is electrically connected to the reference voltage source Vss. The second terminal of the second compensation capacitor C2 is electrically connected to the control terminal of the first driver transistor T1. In this embodiment, the first compensation capacitor C1 and the second compensation capacitor C2 form a capacitive coupling circuit. There is a first node A between the first compensation capacitor C1 and the second compensation capacitor C2. In some embodiments, the first node A corresponds to the control terminal of the first driver transistor T1, so that when the first node A receives the input signal Vin (e.g., data signal configured to control the lightness of the light emitting element 110), and the input signal Vin has a voltage change, the capacitive coupling circuit changes a gate voltage of the first driver transistor T1 according to the Capacitive coupling effect between the first compensation capacitor C1 and the second compensation capacitor C2.

In some embodiments, the threshold voltage value of the first driver transistor T1 and the threshold voltage value of the second driver transistor T2 have a first matching relationship. The capacitance value of the first compensation capacitor C1 and the capacitance value of the second compensation capacitor C2 have a second matching relationship. The first matching relationship is the same as the second matching relationship. For example, the ratio of the threshold voltage value of the first driver transistor T1 and the threshold voltage value of the second driver transistor T2 is 1 to 1. The ratio of the capacitance value of the first compensation capacitor C1 and the capacitance value of the second compensation capacitor C2 is also 1 to 1. In other embodiments, the ratio of the threshold voltage value of the first driver transistor T1 and the threshold voltage value of the second driver transistor T2 is 2 to 1. The ratio of the capacitance value of the first compensation capacitor C1 and the capacitance value of the second compensation capacitor C2 is also 2 to 1. Specifically, the ratio of the threshold voltage value of the first driver transistor T1 and the threshold voltage value of the second driver transistor T2 is the same as the ratio of the capacitance value of the first compensation capacitor C1 and the capacitance value of the second compensation capacitor C2. Accordingly, when the pixel circuit 100 is in the compensation period, the voltage of the compensation node C is substantially twice the voltage of the control terminal of the second driving transistor T2. In this embodiment, the first driver transistor T1 and the second driver transistor T2 have the same threshold voltage value, and the first compensation capacitor C1 and the second compensation capacitor C2 have the same capacitance value.

In some other embodiments, the pixel circuit 100 further includes a transistor switch T3. The transistor switch T3 includes a first terminal, a second terminal and a control terminal. The first terminal of the transistor switch T3 is configured to receive the input signal Vin. In the data input period, the input signal Vin is a data signal. In addition, the second terminal of the transistor switch T3 is electrically connected to the control terminal of the first driver transistor T1. The control terminal of the transistor switch T3 is configured to receive the gate signal S1 in order to decide to turn on or turn off the transistor switch T3 according to the gate signal S1.

Figure 2:
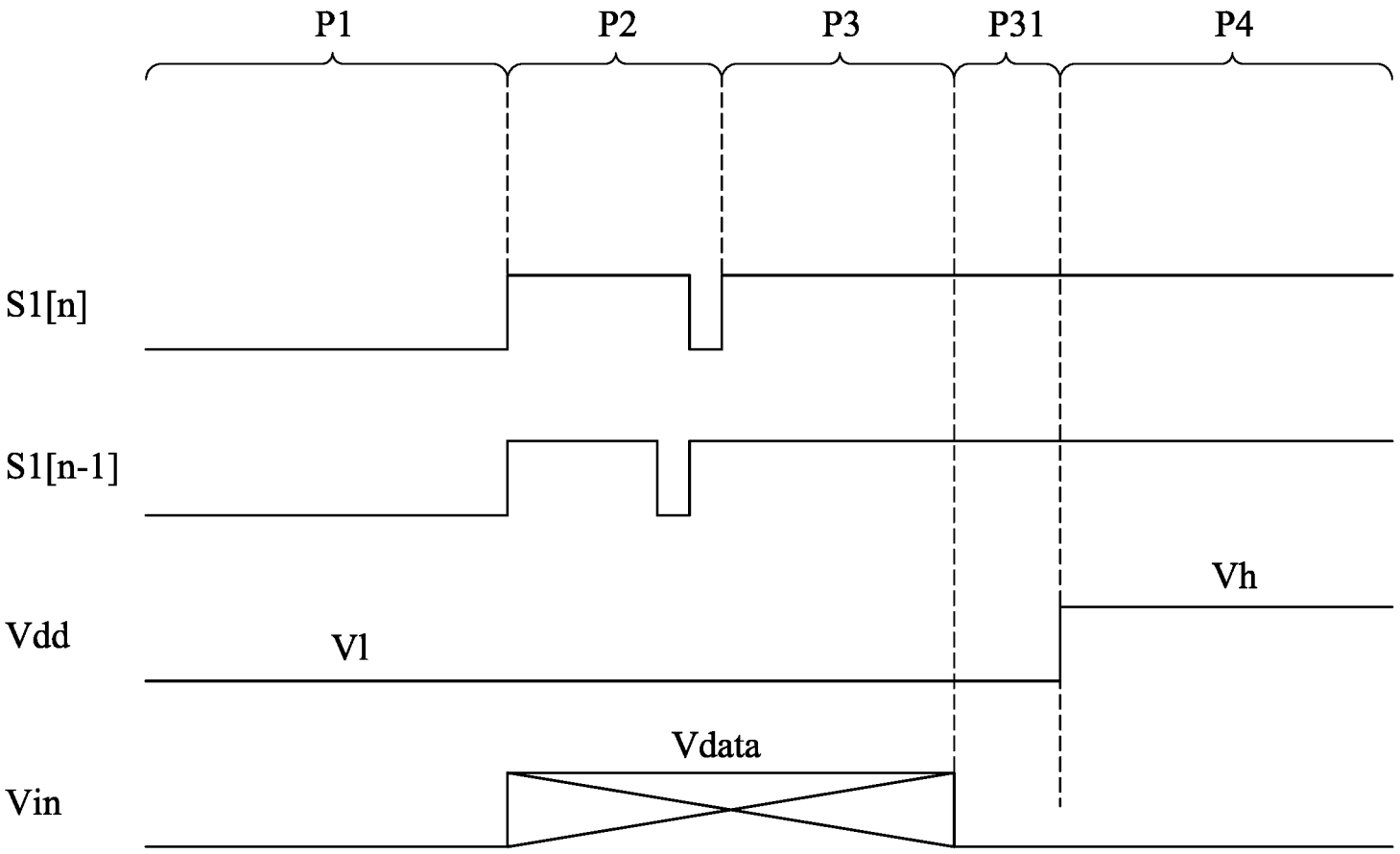
FIG. 2 is a waveform diagram of a pixel circuit in some embodiments of the present disclosure.

In order to clearly explain the operation manner of the pixel circuit 100, taking FIG. 3A-3D as an example to illustrate the operation of the pixel circuit 100. Referring the FIG. 2 and FIG. 3A-3D, FIG. 2 is a waveform diagram of a pixel circuit in some embodiments of the present disclosure. As shown in FIG. 2, a working period of a pixel circuit 100 includes a reset period P1, a data input period P2, a compensation period P3 and a lighting period P4. In some embodiments, the reset period P1, the data input period P2, the compensation period P3 and the lighting period P4 are sequentially arranged. In this embodiment, the pixel circuit 100 is applied to a display device. The processor of the display device sequentially drives each row of the pixel circuit 100. Therefore, S1[$n$] in FIG. 2 represents a gate signal for controlling the pixel circuit 100 shown in FIG. 3A-3D. S1[$n-1$] represents the gate signal of the pixel circuit for driving another row adjacent to the pixel circuit 100.

Figure 3A:
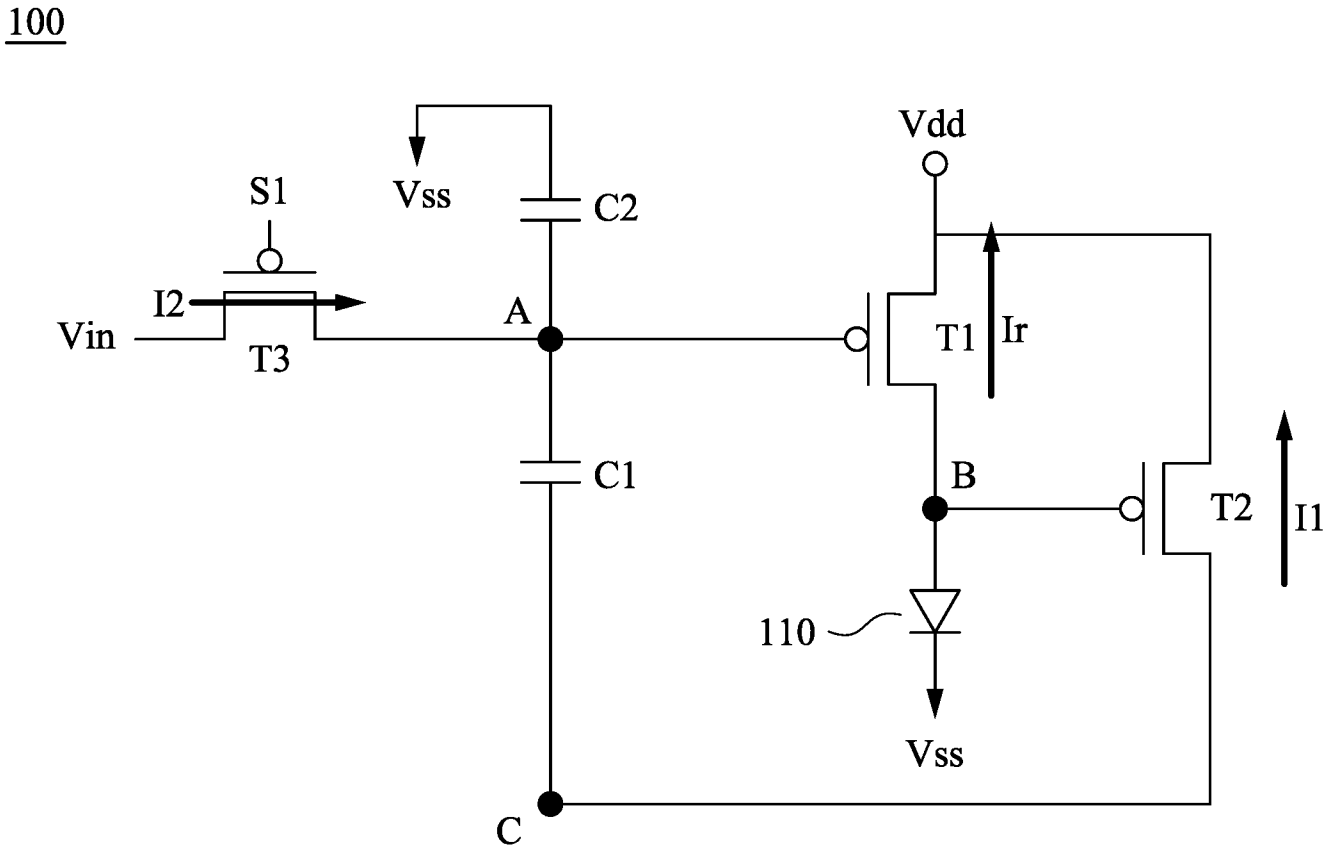
FIG. 3A-3D are schematic diagrams of the pixel circuit operating in different period in some embodiments of the present disclosure.

Referring to FIGS. 2 and 3A, in the reset period P1, the gate signal S1 is at the an enable signal to turn on the transistor switch T3, and a current flows through the second current I2. Since the transistor switch T3 is turned on, the control terminal of the first driver transistor T1 receives the input signal Vin transmitted from the display device through the transistor switch T3, so that the first driver transistor T1 is turned on, and the control terminal of the first driver transistor T1 may be charged to a reference voltage of the input signal Vin.

For example, in this embodiment, the first driver transistor T1, the second driver transistor T2 and the transistor switch T3 are P-type Thin-Film Transistors. For the P-type Thin-Film Transistor, the disable level is high level voltage, enable level is low level voltage. In other embodiments, when the first driver transistor T1, the second driver transistor T2 and the transistor switch T3 are N-type Thin-Film Transistors, the enable level is high level voltage, disable level is low level voltage. In some embodiments, the reference voltage of the input signal Vin is low level voltage, it is a enable level for the first driver transistor T1. Accordingly, when the gate signal S1 is at the low level voltage and turned on the transistor switch T3, the input signal Vin control the first node A to the low level voltage so as to turned on the first driver transistor T1.

In addition, in the reset period P1, the power signal Vdd is low level voltage Vl, so that the first first terminal of the driver transistor T1 receives the low voltage signal. Since in the reset period P1, the second node B of the pixel circuit 100 (i.e., the positive terminal of the light emitting element 110) still maintain to the voltage value in the previous working period, which is configured to the light emitting element 110 lighting (i.e., high level voltage in this embodiment and corresponding to the previous lighting period P4). Accordingly, in the beginning of the reset period P1, the first terminal of the first driver transistor T1 is low level, and the second terminal is high level, so that the second node B starts discharging via the driver transistor T1. At this time, the reset current Ir flows to the first driver transistor T1 from the light emitting element 110 to discharge, and the reset is performing.

The voltage of the second node B is discharged to a voltage, which is different from the voltage of the first node A by a threshold voltage. In some embodiments, the first node A has a low level close to zero. Therefore, the voltage value of the second node B is the threshold voltage value Vth of the first driver transistor T1, so that the second driver transistor T2 is also turned on, and generating the first current I1. When the second driver transistor T2 is turned on, the voltage of the compensation node C is discharged to the sum of the threshold voltage value Vth of the first driver transistor T1 and the threshold voltage value Vth of the second driver transistor T2. In this embodiment, since the threshold voltage value Vth of the first driver transistor T1 is the same as the threshold voltage value Vth of the second driver transistor T2, the voltage of the compensation node C will be twice the threshold voltage value Vth. When the compensation node C discharges to a predetermined value, the second driver transistor T2 will turn off.

Figure 3B:
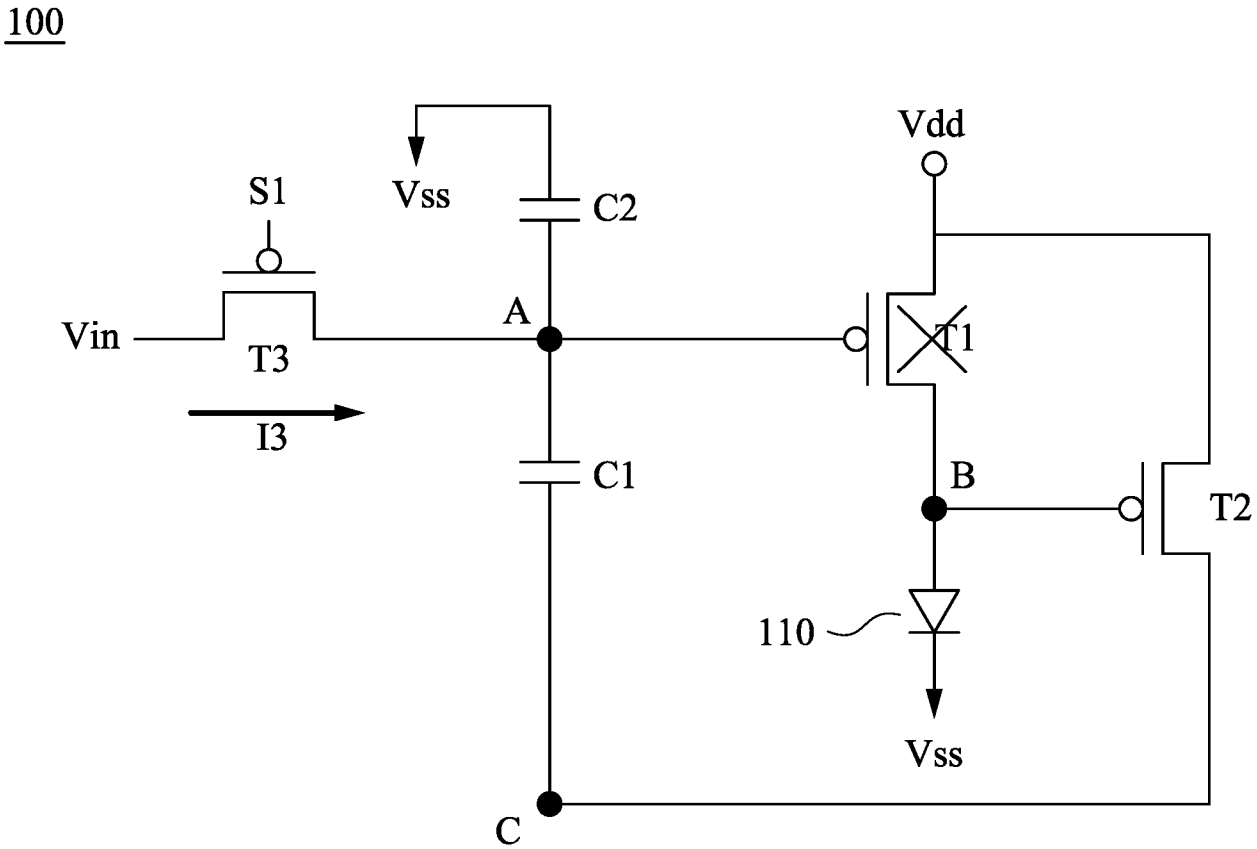

Referring to FIG. 2 and FIG. 3B, In the data input period P2, the input signal Vin is the data signal Vdata in high level, and the gate signal S1 is the enable signal. Therefore, the transistor switch T3 is turned on, so that the first terminal of the transistor switch T3 receives the data signal Vdata, and the third current I3 flows the transistor switch T3. At this time, since the data signal Vdata is disabled for the first driver transistor T1, the first driver transistor T1 is turned off. In this embodiment, since the voltage of the first node A is low level and close to zero in the reset period P1, when the pixel circuit 100 receives the data signal Vdata in the data input period P2, the voltage value of the first node A rises. The amount of the voltage rise of the first node A is the amount of the data signal Vdata. According to the Capacitive coupling effect between the first compensation capacitor C1 and the second compensation capacitor C2, the voltage value of the compensation node C will also change accordingly (such as "2Vth+Vdata") so as to turn on the second driver transistor T2.

Figure 3C:
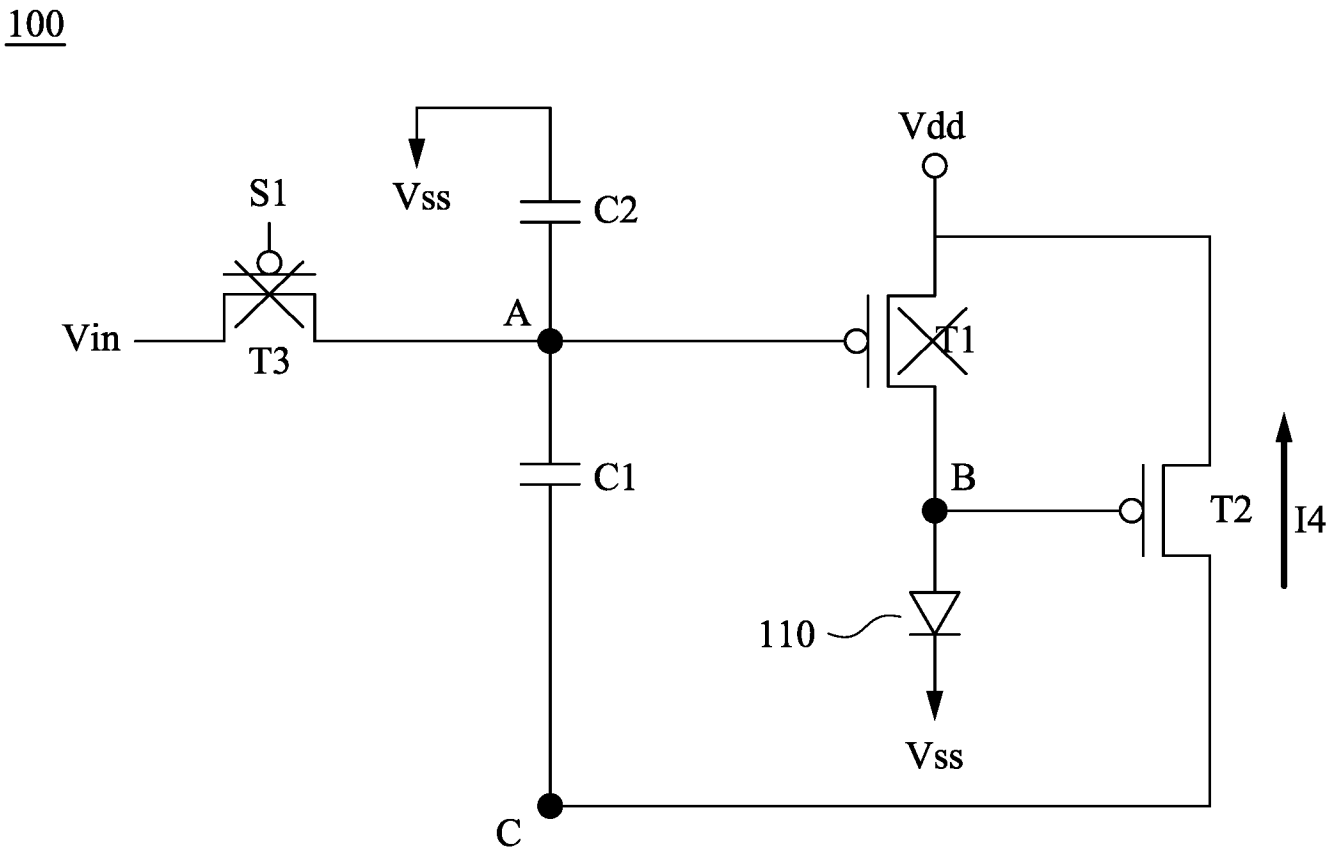
Figure 3D:
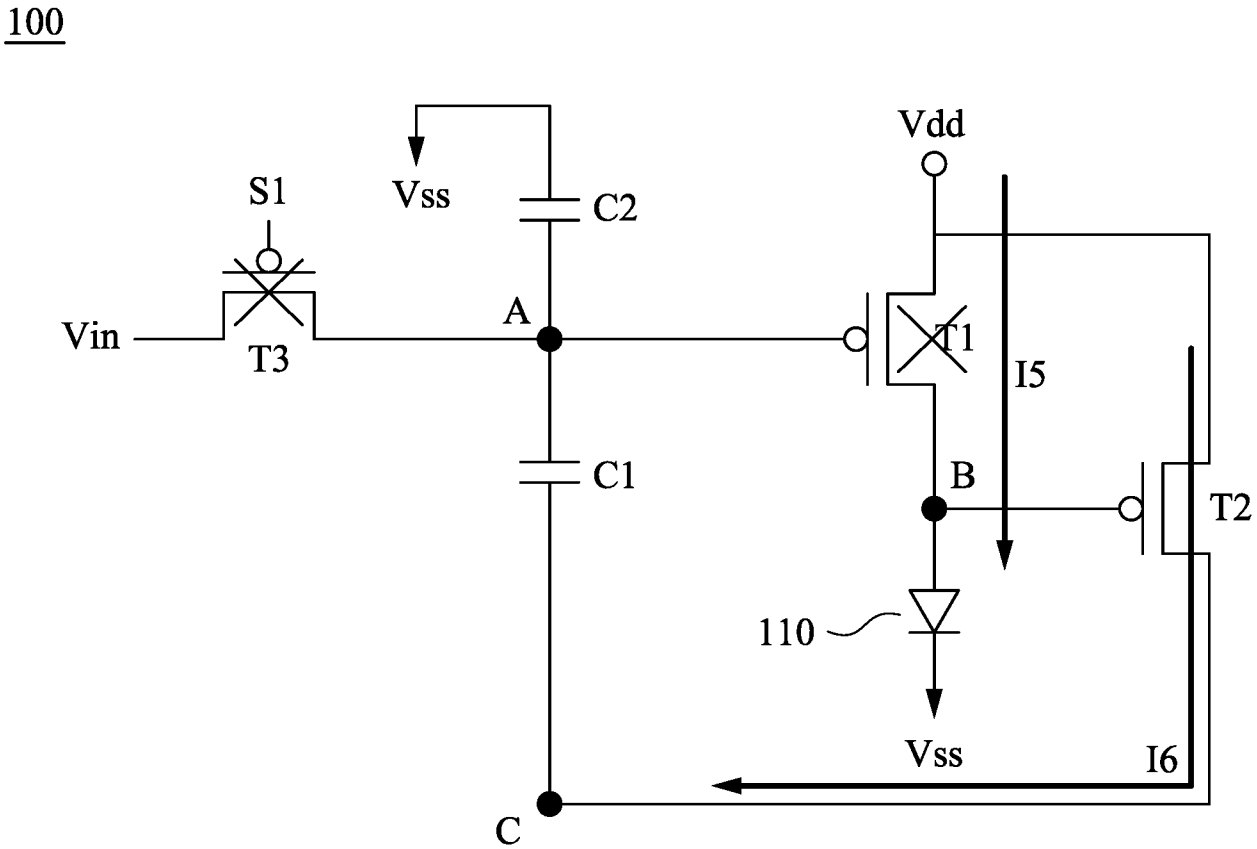

Referring to FIG. 2 and FIG. 3C, once the second driver transistor T2 is turned on and the fourth current I4 is generated, the compensation node C will discharge through the second driver transistor T2, so that the pixel circuit enters the compensation period P3. In the compensation period P3, the gate signal S1 is a disable signal to turn off the transistor switch T3. The first driver transistor T1 and the second driver transistor T2 are both turned on. At this time, since the pixel circuit 100 stops receiving the data signal Vdata, the voltage value of the first node A will become a variable state. The voltage value of the compensation node C is discharged through the second driver transistor T2, so that the voltage value of the control terminal of the first driver transistor T1 (i.e., the first node A) decreases corresponding to the voltage change of the compensation node C.

In some embodiments, since the threshold voltage value Vth of the first driver transistor T1 matches the threshold voltage value Vth of the second driver transistor T2, the compensation node C is discharged until the voltage is equal to twice the threshold voltage value Vth, and the voltage of the compensation node C is substantially twice the voltage of the control terminal of the second driver transistor T2. That is, the voltage of the compensation node C will be reduced from "2Vth+Vdata" to "2Vth", and the voltage variation range is "Vdata". According to the Capacitive coupling effect between the first compensation capacitor C1 and the second compensation capacitor C2, the voltage value of the first node A will also change accordingly. Since the capacitance values of the first compensation capacitor C1 and the capacitance values of the second compensation capacitor C2 are the same in this embodiment, the voltage variation range of the first node A should be half of "Vdata" according to the voltage division law. That is, the voltage of first node A will become 0.5 Vdata.

In the lighting period P4, the first driver transistor T1 and the second driver transistor T2 are turned on to generate a fifth current I5 and a sixth current I6, respectively. The gate signal S1 maintains the disable signal, so that the transistor switch T3 is turned off, and the voltage value of the control terminal of the first driver transistor T1 rises corresponding to the voltage change of the compensation node C. In some embodiments, the power signal Vdd is raised to the high level voltage Vh to change the voltage value of the second node B and to ensure that the second driver transistor T2 is also turned on. The compensation node C is charged to the high level voltage Vh by the power signal Vdd through the second driver transistor T2. That is, the voltage of the compensation node C will rise from 2Vth to Vh, and the voltage change range is "Vh−2Vth". As mentioned above, the voltage of the first node A will be half of the voltage change of the compensation node C, so that the voltage of the first node A will become "0.5Vdata+0.5Vh−Vth".

According to the current formula of the transistor "$I=K\times(Vsg-Vth)^2$", K represents the multiplier value of a carrier mobility of the first driver transistor T1, the unit capacitance of the gate oxide layer and a ratio of the gate width and the gate length. Vsg is the voltage difference between the second terminal (source terminal) and the control terminal of the first driver transistor T1. Vth is the threshold voltage value of the first driver transistor T1. Since the first terminal and the second terminal of the first driver transistor T1 are regarded as a short circuit when the first driver transistor T1 is turned on, the second terminal (source terminal) of the first driver transistor T1 can be regarded as high level voltage Vh. The above formula can be "$I=K\times(Vdd-(0.5Vdata+0.5Vh-Vth)-Vth)^2$". Since the current I is independent of the threshold voltage value Vth, it can be ensured that the lighting intensity of the light emitting element 110 is not affected by the variation of the threshold voltage value Vt.

Referring the waveform diagram shown in FIG. 2. In this embodiment, all the pixel circuits 100 in the display device enter the reset period P1 at the same time. Then, in the data input period P2, different rows of pixel circuits 100 sequentially receive the data signal Vdata. After all the pixel circuits 100 have completed the data input period P2, all the pixel circuits 100 enter the compensation period P3. In some embodiments, and there is a buffer phase P31 after the compensation period P3. Through the buffer stage P31, the display device can ensure that all the pixel circuits 100 enter the lighting period P4 after compensation, so that each pixel circuit produce the desired ideal lightness. The length of the buffer phase P31 is based on the characteristics of the first driver transistor T1 and the second driver transistor T2. In other parts of the embodiment, the lighting period P4 is directly connected to the compensation period P3.

As described above, in the working period of the pixel circuit 100, the pixel circuit 100 is entered into different operation period by controlling whether the input signal Vin is input or not (e.g., changing the gate signal S1). The pixel circuit 100 has a 3T2C circuit architecture (i.e., includes three transistors and two capacitors), which reduces circuit cost and makes it easier to control. In addition, when the pixel circuit is not in the lighting period P4, the power signal Vdd is controlled to the low level voltage Vl, which can avoid an abnormal state that display device flashes.

It will be apparent to those skilled in the art that various modifications and variations can be made to the structure of the present disclosure without departing from the scope or spirit of the present disclosure. In view of the foregoing, it is intended that the present disclosure cover modifications and variations of this present disclosure provided they fall within the scope of the following claims.

What is claimed is:

1. A pixel circuit, comprising:

a light emitting element;

a first driver transistor comprising a first terminal, a second terminal and a control terminal, wherein the first terminal of the first driving transistor is configured to receive a power signal, and the second terminal of the first driving transistor is electrically connected to the light emitting element;

a second driver transistor comprising a first terminal, a second terminal and a control terminal, wherein the first terminal of the second driving transistor receives the power signal, and the control terminal of the second driving transistor is electrically connected to the light emitting element;

a first compensation capacitor electrically connected to the control terminal of the first driving transistor and the second terminal of the second driving transistor; and a second compensation capacitor comprising a first terminal and a second terminal, wherein the first terminal of the second compensation capacitor is electrically connected to a reference voltage source, and the second terminal of the second compensation capacitor is electrically connected to the control terminal of the first driver transistor;

wherein a threshold voltage value of the first driver transistor matches to a threshold voltage value of the second driver transistor;

wherein the second terminal of the second driver transistor is electrically connected to the first compensation capacitor through a compensation node.

2. The pixel circuit of claim 1, wherein the threshold voltage value of the first driving transistor and the threshold voltage value of the second driving transistor have a first matching relationship, a capacitance value of the first compensation capacitor and a capacitance value of the second compensation capacitor have a second matching relationship, and the first matching relationship is the same as the second matching relationship.

3. The pixel circuit of claim 2, wherein the first driving transistor and the second driving transistor have the same threshold voltage value, and the first compensation capacitor and the second compensation capacitor have the same capacitance value.

4. The pixel circuit of claim 1, further comprising:

a transistor switch comprising a first terminal, a second terminal and a control terminal, wherein the first terminal of the transistor switch is configured to receive a data signal, the second terminal of the transistor switch is electrically connected to the control terminal of the first driving transistor, and the control terminal of the transistor switch is configured to receive a gate signal.

* * * * *